US005812034A

United States Patent [19]

Yoshida

[11] Patent Number: 5,812,034

[45] Date of Patent: Sep. 22, 1998

[54] WAVEGUIDE MODE-STRIP LINE MODE CONVERTER UTILIZING FIN-LINE ANTENNAS OF ONE WAVELENGTH OR LESS

[75] Inventor: Haruo Yoshida, Gyoda, Japan

[73] Assignee: Advantest Corporation, Tokyo, Japan

[21] Appl. No.: 540,885

[22] Filed: Oct. 11, 1995

[30] Foreign Application Priority Data

Oct. 17, 1994 [JP] Japan ..... 6-250408

[51] Int. Cl.[6] ..... H01P 5/08; H01P 1/16

[52] U.S. Cl. ..... 333/125; 333/26; 333/128; 333/136; 333/137; 333/250

[58] Field of Search ..... 333/26, 125, 127, 333/128, 136, 137, 245, 246, 248, 250, 254

[56] References Cited

U.S. PATENT DOCUMENTS 4,291,278 9/1981 Quine ..... 333/128 X

OTHER PUBLICATIONS

Hamilton, C. A., "The NBS Josephson Array Voltage Standard", *IEEE Transactions on Instrumentation and Measurements*, vol. IM–36, No. 2, Jun. 1987, pp. 258–261.

*Primary Examiner*—Benny T. Lee
*Assistant Examiner*—Barbara Summons
*Attorney, Agent, or Firm*—Staas & Halsey

[57] ABSTRACT

A fin-line antenna 51 comprises fins 51*a* and 51*b* and a fin-line antenna 52 comprises fins 52*a* and 52*b*. The fins 51*b* and 52*b* are integrated into one body and connected to a ground layer of a strip line 31. The length of each antenna 51 or 52 is one wavelength. A millimetric wave of waveguide mode which is received by one of the antennas 51 and 52 is split into four paths and each split wave is injected into each of four divided portions of a signal line of the strip line 31 comprising series connections of many Josephson junctions. One end of each divided portion is grounded via a termination resistor 38 and a capacitor 39. A summed output of the generated voltage of each Josephson junction is obtained between both ends 42 and 43 of the strip line 31.

19 Claims, 9 Drawing Sheets

WAVEGUIDE MODE-STRIP LINE MODE CONVERTER UTILIZING FIN-LINE ANTENNAS OF ONE WAVELENGTH OR LESS

BACKGROUND OF THE INVENTION

The present invention relates to a propagation mode converter which is used, for example, for a voltage standard, a super high resolution current/voltage measuring apparatus ect. The propagation mode converter of the present invention receives an electro-magnetic wave propagating in waveguide mode by an antenna and converts the received wave to strip line mode or performs the reverse conversion. A strip line where a signal line is formed by series connections of many Josephson junctions can be used as the strip line. In this case, the electro-magnetic wave propagating in waveguide mode is injected into the strip line and voltage obtained at each Josephson junction forming the strip line is summed, and then the summed voltage is outputted. A Josephson junction array having an antenna to which the mode converter of this type is applied and a voltage standard generator using the Josephson junction array are shown, for example, in "The NBS Josephson Array Voltage Standard" by C. Hamilton et. al., IEEE Trans., Instrum. Meas., vol. IM-36, No.2, June 1987, pp. 258–261.

FIG. 1 shows a Josephson array to which this prior art waveguide mode-strip line mode converter is applied. An antenna 12 FIG. 2A is formed on a half part of a dielectric array substrate 11 and a Josephson junction array 13 is formed on the other half part of the substrate 11. As shown in FIG. 2A, a groove 16 is formed at the center of the longer side of one end of a rectangular waveguide 15. The array substrate 11 is inserted to the groove 16 to locate the antenna 12 inside of the waveguide 15.

The antenna 12 is a fin-line antenna, a fin 12*b* is a part of the ground plane formed on the array substrate of silicon, and the other fin 12*a* is formed on a dielectric film evaporated on the ground plane. The length of the fin-line antenna 12 is 2 wavelength (so called reduced wavelength on a substrate influenced by the waveguide 15 and the array substrate 11) of the electro-magnetic wave propagating through the waveguide 15. The respective, outside edge parts $\mathbf{12}a_i$ and $\mathbf{12}b_1$ of the fins 12*a* and 12*b*, each of which is engraved with slots, are positioned at the groove 16 of the waveguide 15 and connected to the waveguide 15 so that the high frequency is grounded.

A part of the cross section of the Josephson junction array 13 is shown in FIG. 2B wherein a Josephson junction array 27 is constructed by forming a ground layer 19 of Nb on the entire surface of a silicon wafer 18, forming a dielectric layer 21 of SiO on the entire surface of the ground layer 19, forming a line shaped Nb layer 22 discretely on the dielectric layer 21, forming a $Al_2O_3$ layer 23 on the line shaped Nb layer 22, forming a pair of Nb layers 24 aligned along the longer side direction on the $Al_2O_3$ layer 23, separating each group of the Nb layer 22, $Al_2O_3$ layer 23 and Nb layer 24 by an SiO separation part 25 of the same interval in the longer side direction, and interposing an SiO separation part 26 between the Nb layers 24 on the $Al_2O_3$ layer 23 so that a Josephson junction 27 is formed by the Nb layer 22, the $Al_2O_3$ layer 23 and the Nb layer. These Josephson junctions 27 are serially connected by connection conductor layers 28 of PbIn. A strip line 31 is constructed by these series connections of the Josephson Junctions as a signal line 29 along with the ground layer 19.

The array substrate 11 is cooled in a vessel of liquid helium (not shown), such that the ground layer 19 is super conductive. Thus, the loss of the strip line 31 is approximately zero. The strip line 31 is turned up zigzag as shown in FIG. 1. As shown in FIG. 2A, the fin-line antenna 12 is located at the center of the longer side of the cross section of the waveguide 15 where, regarding the electro-magnetic wave 10 propagating in $TE_{10}$ mode in the waveguide 15, the plane of the fin-line antenna 12 is orthogonal with the magnetic field H and parallel with the electric field E, and thus the power density is maximum in the calculation from pointing vector. The electro-magnetic wave 10 received by the fin-line antenna 12 is supplied to the strip line 31 in the state that the matching between the fin-line antenna 12 and the strip line 31 is in place.

The cross sections indicated by chain lines a, b, c and d (FIG. 1) are shown in FIGS. 3A, 3B, 3C and 3D respectively. Regarding the chain lines a and b, the fins 12*a* and 12*b* are positioned on both sides of the dielectric layer 21 respectively. The positions of fins 12*a* and 12*b* are displaced from each other when viewing from the direction perpendicular to the dielectric layer 21, and also each inner side of the fins is a ridge, part of which is shaped like an exponential function curve. The electric fields between those fins are shown in dotted lines in FIGS. 3A, 3B, 3C, and 3D. At the position of the chain line c, conductors 32*a* and 32*b* connected to the fins 12*a* and 12*b* on the both sides of the dielectric layer 21 respectively form a balanced transmission line where the two fins are mutually facing. At the position of the chain line d, the signal line 29 and the ground layer 19 connected to the conductors 32*a* and 32*b* respectively form a strip line (unbalanced transmission line) 31. In such an arrangement, a conversion between the characteristic impedance of approximately 450 Ω of the waveguide 15 and the characteristic impedance of approximately 8 Ω of the strip line 31 is achieved.

In this arrangement, the electromagnetic wave received by the antenna 12 is converted to the strip line mode and then, as shown in FIG. 1, split into two paths at a branch point 33, further split into two paths at each of branch points 34 and 35 and further split into two paths at each of branch points 34*a*, 34*b*, 35*a* and 35*b* for injection to the Josephson junction array 13. An equivalent circuit of the strip line 31 consisting of the Josephson junction array 13 is shown in FIG. 4. As shown in FIG. 4, coupling capacitors 36 and 37 for cutting off a D. C. current are connected in series between the branch point 33 and the branch point 34, and between the branch point 33 and the branch point 35 respectively. Each of both signals split at the branch point 34 propagates through the strip line 31 and falls to the ground layer 19 at the end via a termination resistor 38 and a high frequency grounding capacitor 39. Similarly, each signal split at the branch point 35 also propagates through the strip line 31 and falls to the ground layer 19 via a termination resistor 38 and a high frequency grounding capacitor 39. In FIG. 4, a received wave of the antenna 12 is shown as a signal source 41 to be applied to the branch point 33. The voltage generated by each of the Josephson junction 27 (FIG. 2B) is summed up and the summed voltage is obtained between both ends of the series connected Josephson junctions 27 i.e., between the terminals 42 and 43 of the strip line 31.

In the prior art, the length of the antenna 12 is equal to or more than two wavelength and the width $W_1$ (FIG. 1) is equal to the height $h_1$ (FIG. 2A) of the $TE_{10}$ mode waveguide 15 i.e., the maximum width, so that the conversion between the waveguide mode in the waveguide 15 and the strip line mode in the strip line 31 can be performed as efficiently as possible.

However, the conventional waveguide mode-strip line mode converter does not provide an efficient conversion and thus, a longer fin-line antenna of more than two wavelength has been used in order to obtain a larger output in a limited size waveguide. Therefore, in the conventional Josephson junction array, for example, if the physical size of the array substrate is limited, the area for arranging the Josephson junctions is small and the number of Josephson junctions to be arranged is limited. Thus, the Josephson voltage is low accordingly.

Furthermore, in the conventional waveguide mode-strip line mode converter, the transmission efficiency is not good.

SUMMARY OF THE INVENTION

It is an object of the present invention to provide a waveguide mode-strip line mode converter of which conversion efficiency is high.

It is another object of the present invention to provide a waveguide mode-strip line mode converter wherein a smaller antenna can be formed and the conversion efficiency is higher compared with a prior art apparatus.

It is a further object of the present invention to provide a waveguide mode-strip line mode converter wherein the antenna is small, the conversion efficiency is high, and the transmission efficiency is high by making clear the allowable limits for the curvature and the proximity of the strip lines when the strip line is turned up.

It is still a further object of the present invention to provide a waveguide mode-strip line mode converter wherein the sensitivity is the same level as that of the prior art apparatus but the physical size is smaller, and more Josephson junctions can be mounted on the array substrate if the array substrate is the same size as that of the prior art apparatus.

According to the present invention, in a waveguide mode-strip line mode converter where antennas are formed on a half part of a dielectric substrate to be inserted into a waveguide and a strip line connected to these antennas is formed on the other half part of the substrate, n (n is an integer number equal to or greater than 2) antennas and connection means for connecting one end of the strip line to the n antennas are provided.

Each of the n antennas is a fin-line antenna and the length is equal to or less than one wavelength (reduced wavelength on a substrate) of the receiving electro-magnetic wave.

Moreover, the contained angle of the fin-line antenna is less than 6.6 degrees.

The strip line comprises series connections of Josephson junctions and is divided into 4n portions in terms of high frequency. The connecting means connects each of the divided four portion groups to a corresponding one of n antennas.

Also, the ratio R/W of a curvature diameter R of a turning portion of the strip line to a signal line width W is equal to or greater than 3.5.

Also, the ratio S/W of an interval S of the adjacent signal lines to a signal line width W is equal to or greater than 1.5.

BRIEF DESCRIPTION THE DRAWINGS

DESCRIPTION OF THE PREFERRED EMBODIMENTS

Figure 1:
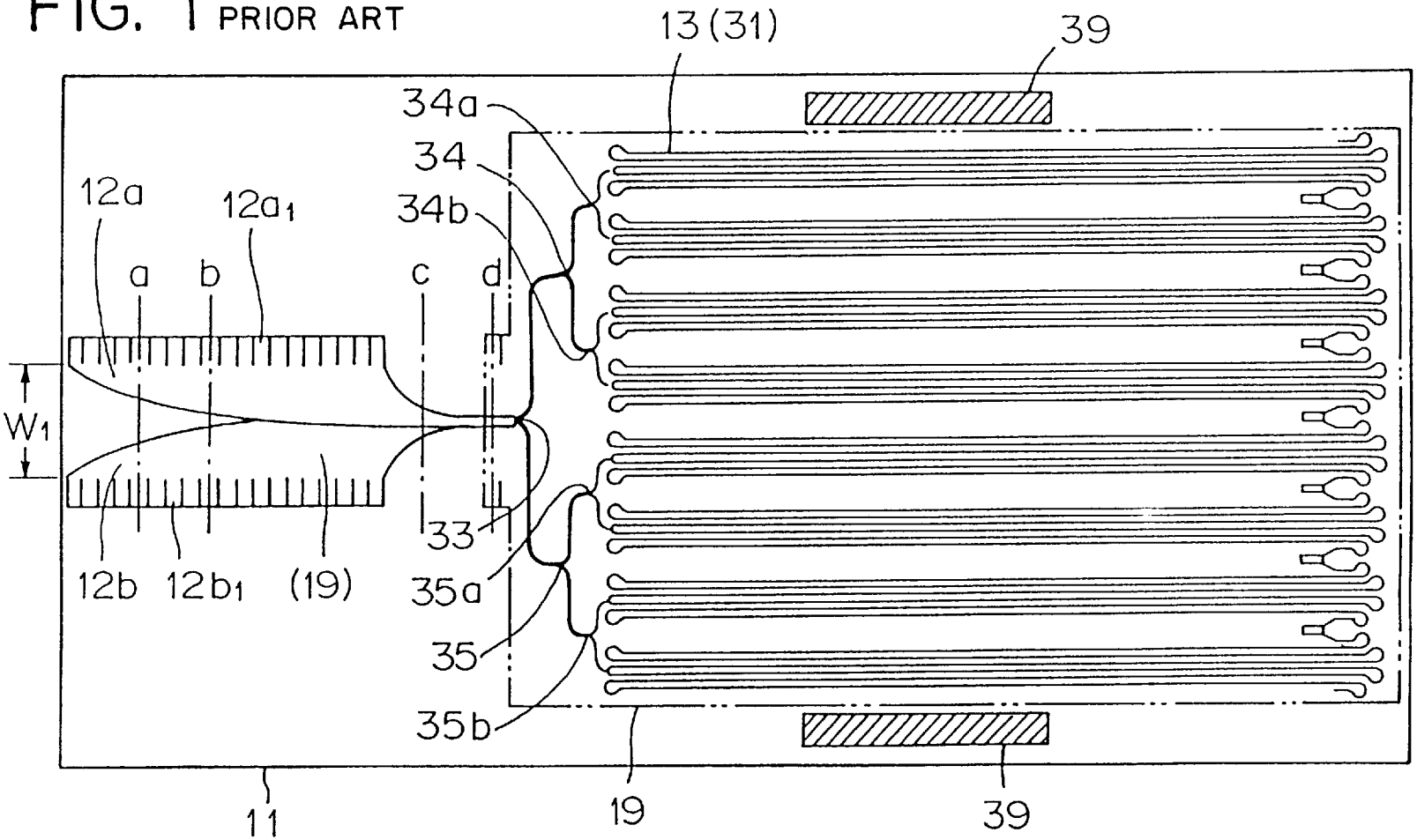
FIG. 1 PRIOR ART
FIG. 1 is a plan view diagram showing a Josephson junction array having a conventional waveguide mode-strip line mode converter.
Figure 4:
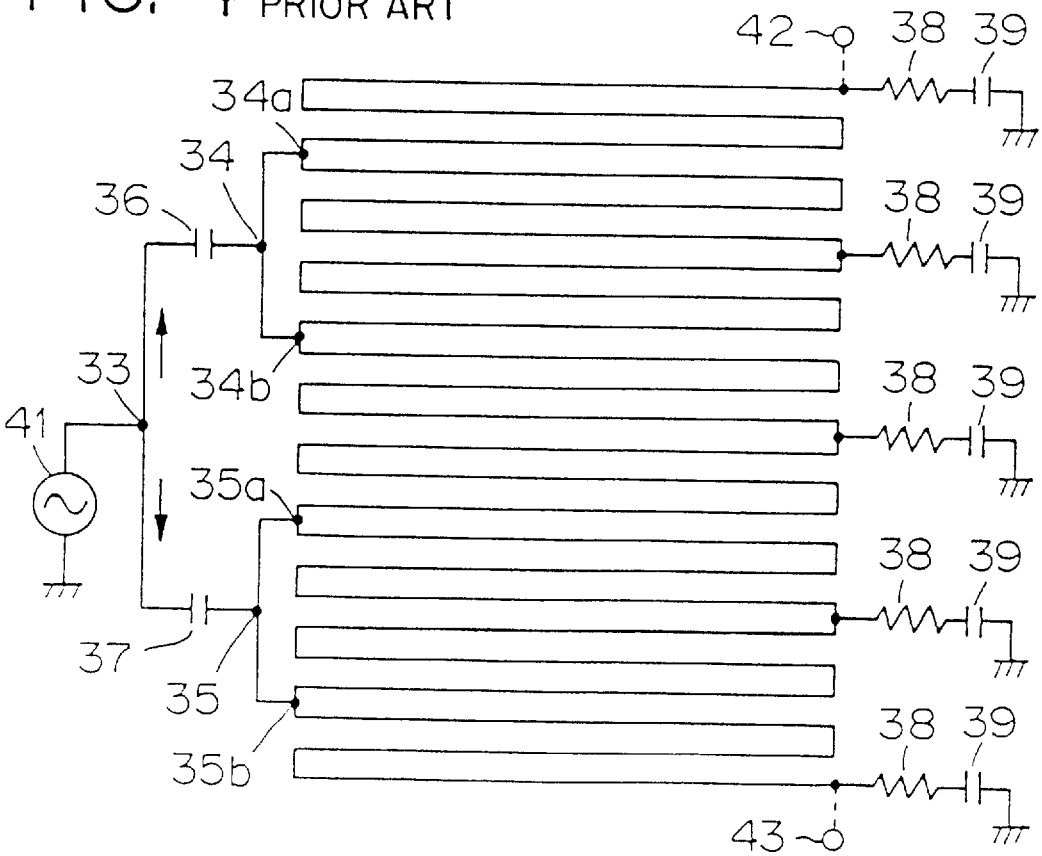
FIG. 4 PRIOR ART
FIG. 4 is an equivalent circuit diagram of the Josephson junction array shown in FIG. 1.

FIG. 5 shows an embodiment of the present invention and same reference symbols are assigned to the respective portions corresponding to those in FIG. 1 and 4.

Figure 2A:
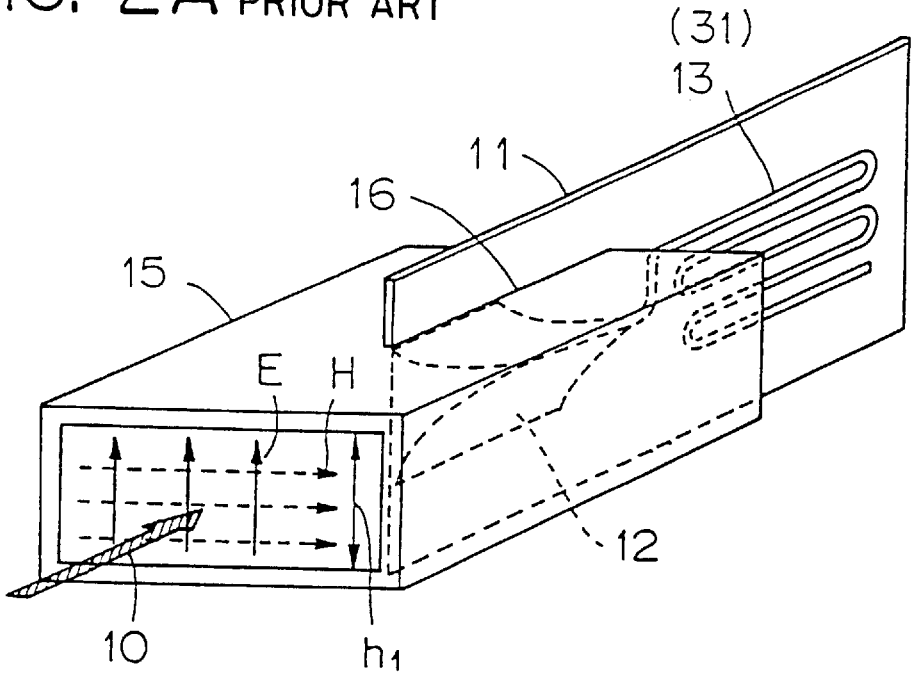
FIG. 2A PRIOR ART
FIG. 2A is an oblique view diagram showing a connection example of a Josephson junction array and a waveguide.
Figure 2B:
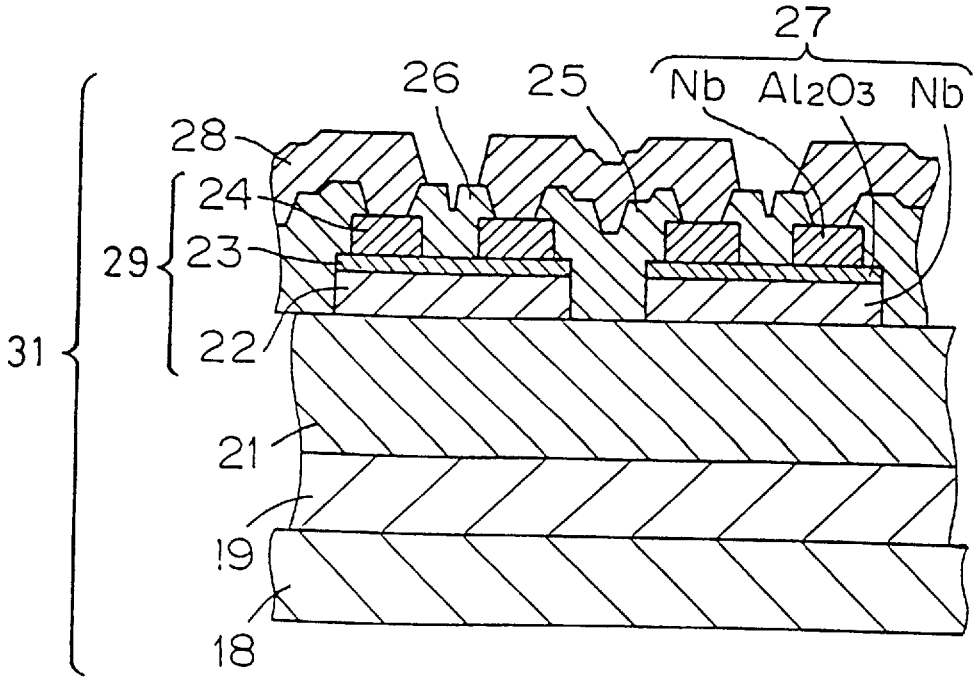
FIG. 2B PRIOR ART
FIG. 2B is a diagram showing a cross section of a strip line 31.
Figure 3A:
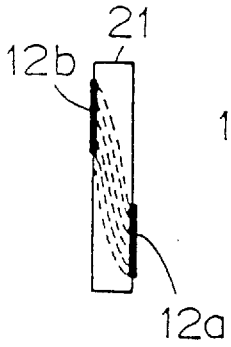
FIG. 3A PRIOR ART
FIGS. 3A-3D show cross sections indicated by chain lines a–d in FIG. 1 respectively.
Figure 3B:
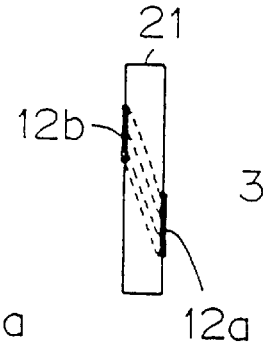
FIG. 3B PRIOR ART
Figure 3C:
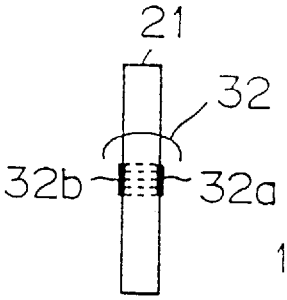
FIG. 3C PRIOR ART
Figure 3D:
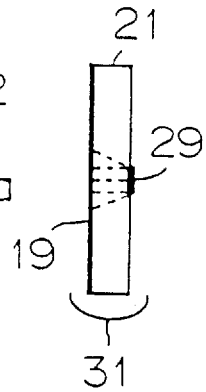
FIG. 3D PRIOR ART

In the present invention, a plurality of antennas (in this embodiment, two antennas 51 and 52) are used. The antennas 51 and 52 are fin-line antennas respectively, wherein the antenna 51 comprises fins 51*a* and 51*b* and the antenna 52 comprises fins 52*a* and 52*b*. Those antennas are directed to the same direction and the fins 51*b* and 52*b* are integrated to form a single body, and the fins 51*a* and 52*a* are formed outside of the fins 51*b* and 52*b* respectively. The fins 51*a* and 52*a* are formed on one side surface of the dielectric layer 21 (FIG. 2B) and the fins 51*b* and 52*b* are formed on the other side surface of the dielectric layer 21. The sum $W_2$ of the width of the antennas 51 and 52 is equal to the height $h_1$ of the waveguide 15 (FIG. 2A) to which those antennas are inserted. The outside edge portions 51*a* and $\mathbf{52}_{a1}$, of the antennas 51 and 52 respectively, where slots are engraved, are positioned at the grooves 16 of the waveguide 15 so that those portions are grounded to the waveguide 15 in terms of high frequency.

Each length of the antennas 51 and 52 is equal to or less than one wavelength. These fin-line antennas 51 and 52 are connected to a strip line in a similar manner shown in FIG. 1 and the impedance conversion is performed. Each received wave from each antenna is split into four and supplied to the Josephson junction array 13. In this example, the Josephson junction array 13 is divided into eight portions and each of eight split received waves from the antennas 51 and 52 is supplied to each of the eight array portions.

Figures 5A, 5B:
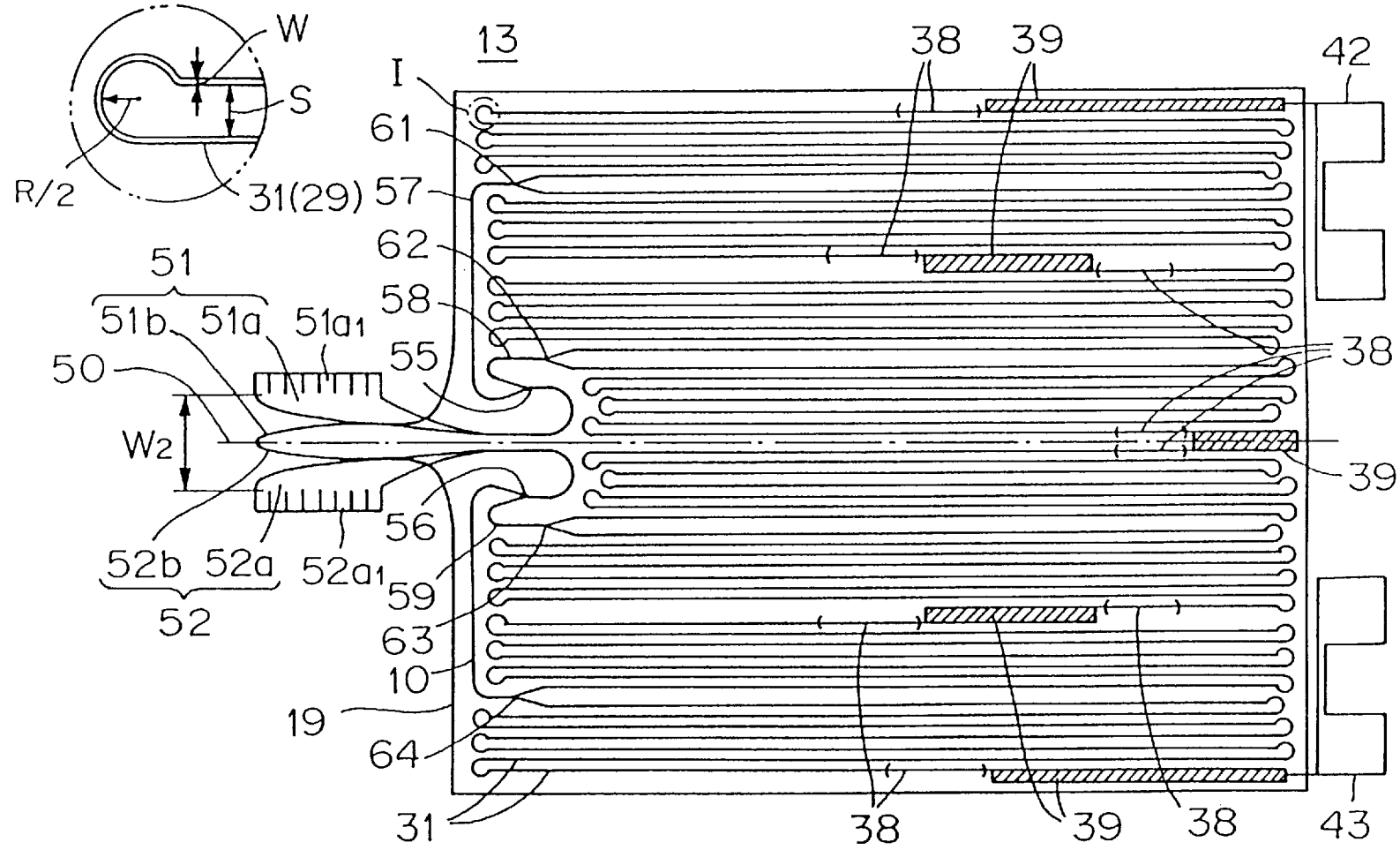
FIG. 5A is a plan view diagram showing an embodiment of the present invention.
FIG. 5B is an enlarged diagram of the chain line circle I in FIG. 5A.
Figure 6:
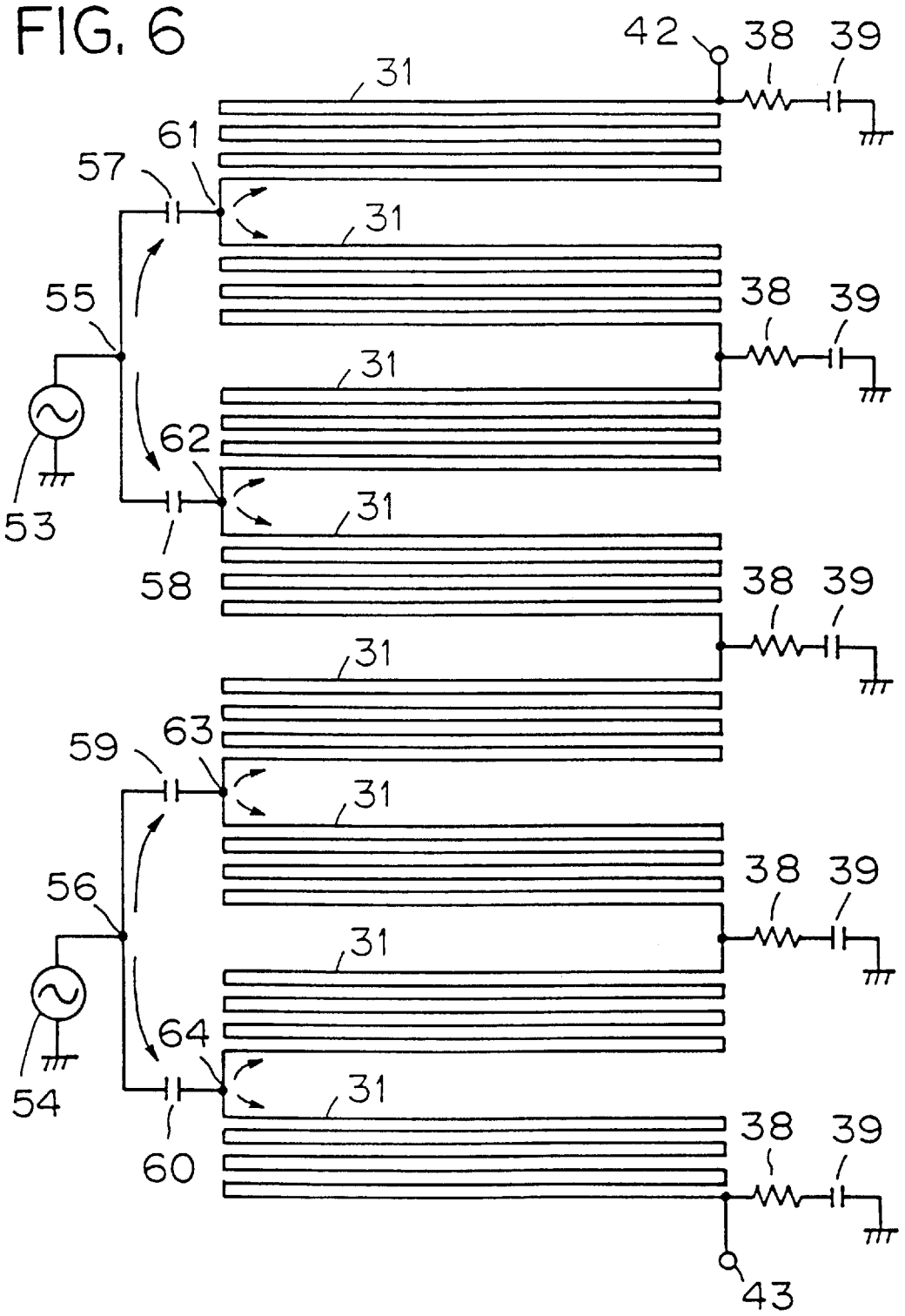
FIG. 6 is an equivalent circuit diagram of the Josephson junction array in the embodiment shown in FIG. 5A.
Figure 7A:
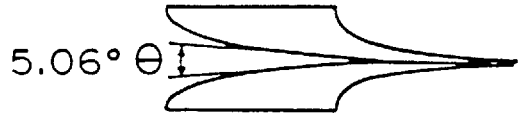
FIGS. 7A–7E show fin-line antenna patterns having various contained angles θ.
Figure 7B:
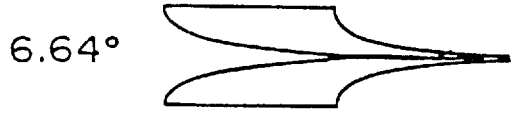
Figure 7C:
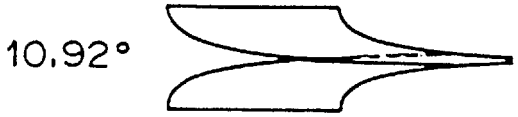
Figure 7D:
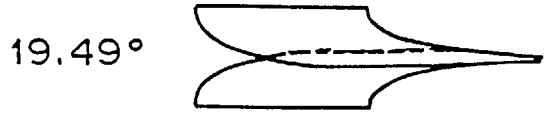
Figure 7E:
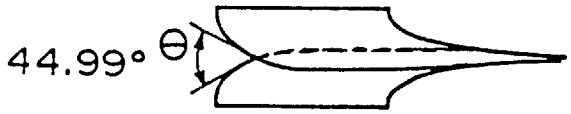

FIG. 6 shows an equivalent circuit for FIG. 5 in a similar manner shown in FIG. 4. Each received wave from the antennas 51 and 52 is split into two paths at each of the branch points 55 and 56 of a Wilkinson type circuit as an output of one of the signal sources 53 and 54. Each of the split signals is coupled to one of respective D.C. cut off capacitors 57–60 and split into two paths at one of respective branch points 61–64 of Wilkinson type circuit and supplied to the respective strip lines 31. Each strip line 31 comprises 7 lines arranged in parallel and connected in series. A signal supplied to the strip line 31 propagates through the strip line and falls to the ground layer 19 via a termination resistor 38 and a high frequency grounding capacitor 39. The summed voltage of the Josephson voltage generated by each Josephson junction 27 is obtained between both end terminals 42 and 43 of the series connections of all the Josephson junctions. In the embodiment shown in FIG. 5A, the strip line 31 is divided into eight portions. Each of the divided portions is constructed such that the strip line positioned in parallel with the longer side direction of the fin-line antennas 51 and 52 is turned up (i.e., folded) six times. Four turned up strip line portions are arranged on both sides of the center line 50 between the antennas 51 and 52. The received wave from the antenna 51 located on one side of the center line 50 is split into four paths at the branch points 55, 61 and 62 and supplied to the four turned up strip line portions located on the same side of the center line 50 as the antenna 51. The received wave from the antenna 52 located on the other side of the center line 50 is split into four paths at the branch points 56, 63 and 64 and supplied to the four turned up strip line portions located on the same side of center line 50 as the antenna 52.

Since the strip line 31 is driven by the received signals from the two antennas 51 and 52, if the total length of the strip line 31 between the terminals 42 and 43 is the same, the length from the driving source to the termination resistor 38 of each strip line 31 is shorter than the conventional case shown in FIG. 1 where the strip line is driven by a single antenna, and thus the loss on the strip line 31 is reduced accordingly.

Figure 8:
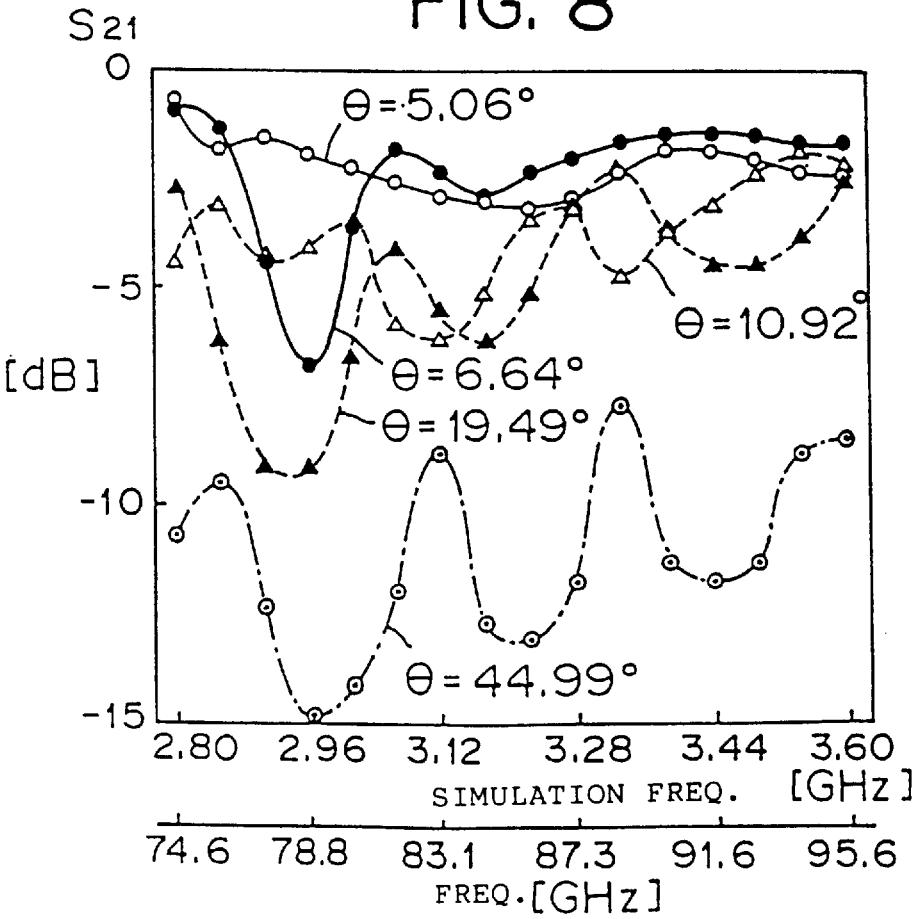
FIG. 8 shows loss characteristics of the antennas having various contained angles shown in FIGS. 7A–7E.

When θ is an angle contained by the tangent lines at each cross point of the inner edges of the respective fins 51*a*, 51*b*, 52*a* and 52*b* of the fin-line antennas 51 and 52, the simulation result of scattering parameter $S_{21}$ (corresponding to receive efficiency) is shown in FIG. 8 for the contained angles (θ) a of 5.06 degrees, 6.64 degrees, 10.92 degrees, 19.49 degrees and 44.99 degrees as shown FIG. 7A–7E. FIG. 8 shows the simulation result of the operation in millimetric wave band 74.6–95.6 GHz simulated by the operation in microwave band 2.80–3.60 GHz. Since these fin-line antennas are designed for 94 GHz as the operation frequency, it is understood from FIG. 8 that the insertion loss is reduced and the variation of the insertion loss characteristics is also reduced for the contained angles less than 6.6 degrees.

Figure 9A:
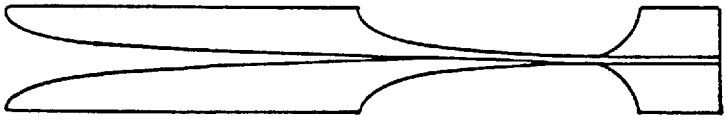
FIG. 9A shows a conventional two wavelength fin-line antenna.
Figure 9B:
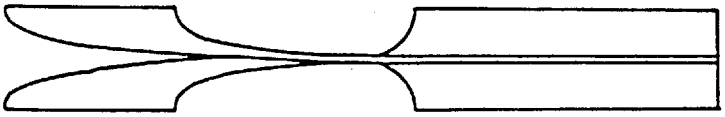
FIG. 9B shows a one wavelength fin-line antenna.
Figure 9C:
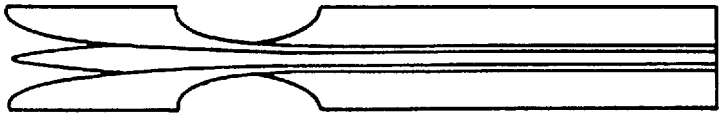
FIG. 9C shows a one wavelength dual fin-line antenna.
Figure 10:
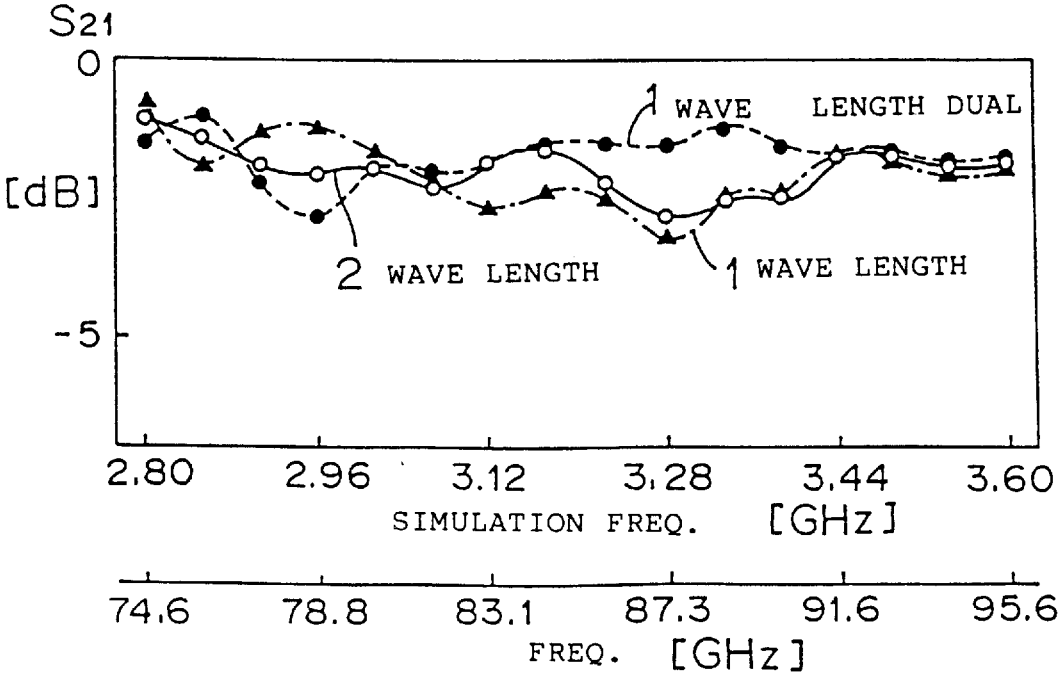
FIG. 10 shows a simulation result of loss characteristics for each antenna shown in FIGS. 9A–9C.

FIG. 9A shows a conventional fin-line antenna with a fin length of two wavelength, FIG. 9B shows a fin-line antenna with a fin length of one wavelength and FIG. 9C shows two fin-line antennas (referred to as dual fin-line antenna) each with a fin-length of one wavelength as shown in FIG. 5. A scaling simulation result of the scattering parameter $S_{21}$ for those antennas is shown in FIG. 10. It is understood from FIG. 10 that the dual fin-line antenna provides equal or better receive efficiency and indicates equal or better (flat) frequency characteristics compared with the conventional fin-line antenna of two wavelength and single structure, or the fin-line antenna of one wavelength and single structure.

Figure 11:
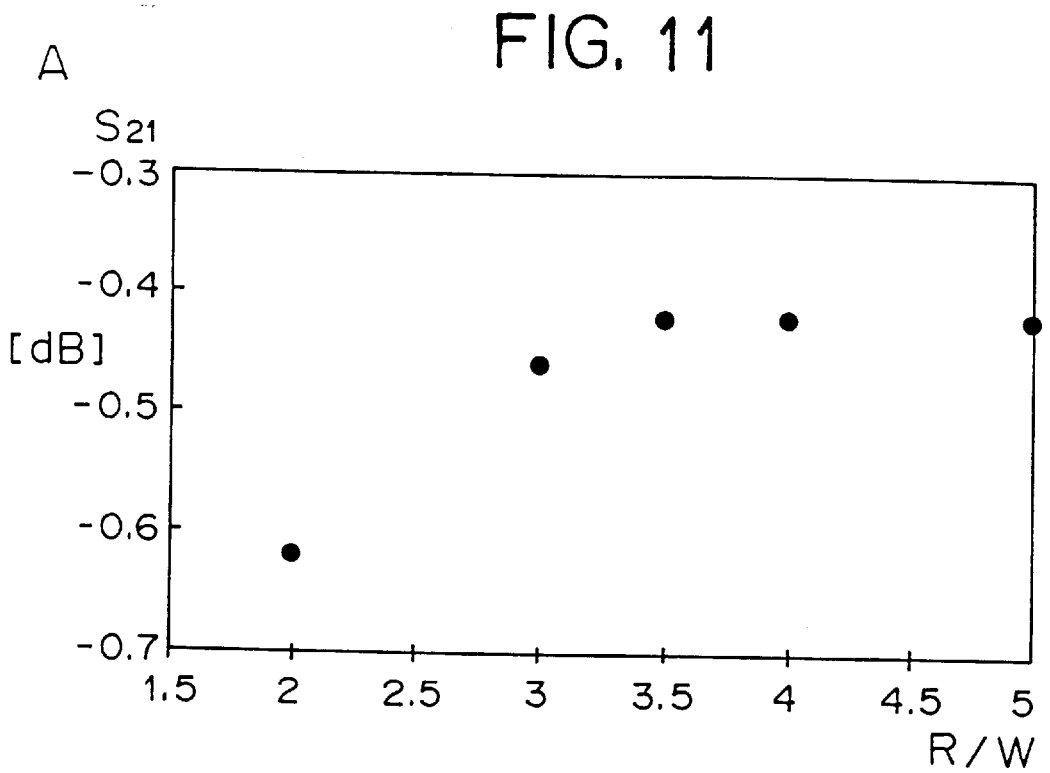
FIG. 11 shows a simulation result for relationship between a strip line curvature diameter R normalized by the signal line width W and the loss.

The relationship between the ratio R/W of the curvature diameter R (refer to FIG. 5S) of the turning part of the strip line 31 to the width W of the signal line 29 of the strip line 31 and the scattering parameter $S_{21}$ in 3.53 GHz is shown in FIG. 11. From FIG. 11, it is understood that the loss significantly increases when R/W is less than 3.5. Therefore, R/W larger than 3.5 provides less reflection and less loss. However, in order for smaller occupied space and more Josephson junctions on a limited space of the array substrate 11, it is recommended to make R/W closer to 3.5.

Figure 12:
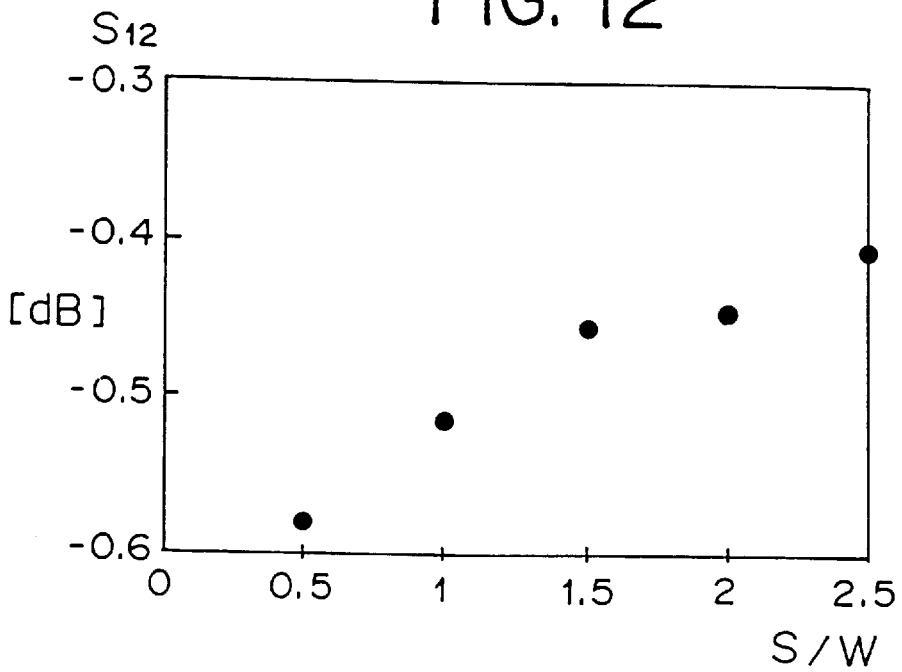
FIG. 12 shows a simulation result for relationship between a strip line interval S normalized by the signal line width W and the loss.

The relationship between the ratio S/W of the interval S of the signal lines 29 to the width W of the signal line 29 and the scattering parameter $S_{21}$ in 3.53 GHz is shown in FIG. 12. From FIG. 12, it is seen that the loss becomes worse in relatively sudden manner because of the mutual interference between adjacent signal lines when S/W is less than the level of 1.5. Therefore, it is understood that S/W of greater than the level of 1.5 is better but S/W of the level of 1.5 is desirable from the view point of the smaller occupied area and more Josephson junctions arranged on a limited space array substrate 11.

Incidentally, the dimensions of the strip line 31 in conventional Josephson junction array are unknown. However, judging from the drawings shown in the prior art, the dimensions seem to be levels of W=50 αm, R=200 αm and S=100 αm. In this case, each of the ratios R/W=4 and S/W=7 is greater than the desirable value in the aforementioned embodiment. Thus, accordingly, the packaging density of Josephson junctions is small.

Although two fin-line antennas 51 and 52 are used in the above embodiment, three or more antennas may be used. A plurality of different type antennas other than fin-line type may also be used if the antenna has a function to convert waveguide mode to strip line mode. Moreover, the waveguide mode-strip line mode converter of the present invention can supply an electromagnetic wave from a waveguide not only to a Josephson junction array but also to other devices or elements via a simple strip line 31 comprising a ground layer, a conductor line and a dielectric layer interposed between the ground layer and the conductor line. The waveguide mode-strip line mode converter of the present invention can also be used to supply an electromagnetic wave propagating through a strip line to a waveguide.

Figure 13:
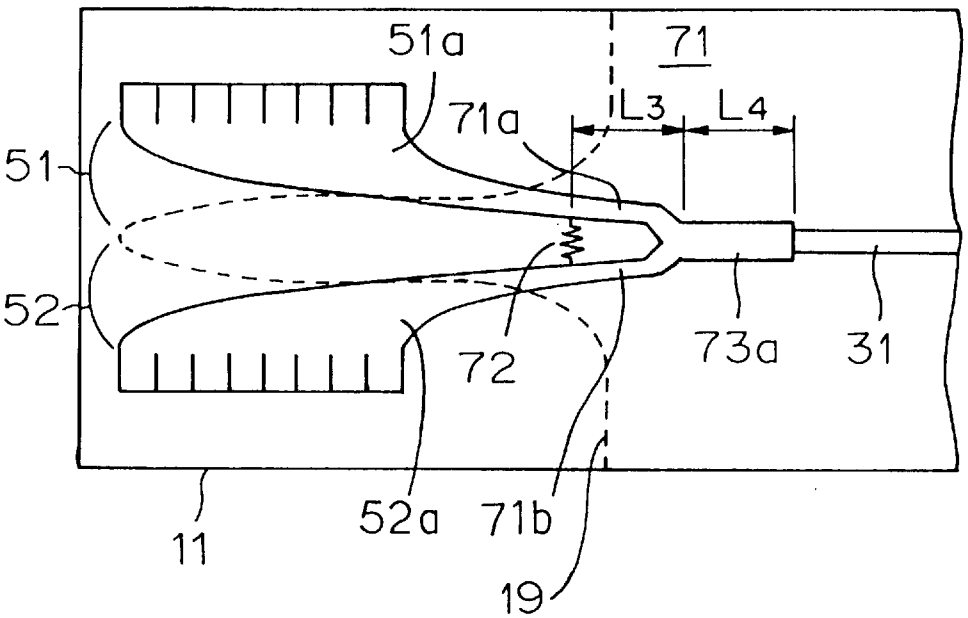
FIG. 13 is a plan view diagram showing another embodiment of the present invention.

That is, an embodiment of a simple conversion between waveguide mode and strip line mode, for example, is shown in, FIG. 13 wherein each portion in FIG. 13 corresponding to the portion in FIG. 5 is given the same reference symbol. In this embodiment, each of fins 51*a* and 52*a* is connected to each one end of ¼ wavelength strip lines 71*a* and 71*b* arranged in nearly parallel, respectively, and each of the other ends of the strip lines 71*a* and 71*b* is connected to one end of a ¼ wavelength strip line 73*a*. The other end of the strip line 73*a* is connected to one end of the strip line 31 and the other end of the strip line 31 is a signal input/output terminal. In order to make the operation frequency band wider, a resistor element 72 is connected between the connection point of the fin 51*a* and the strip line 71*a*, and the connection point of the fin 52*a* and the strip line 71*b* as required. If impedances of the strip lines 71*a*, 71*b* and 73*a* are $Z_1$, $Z_2$ and $Z_3$ respectively, $Z_3$ is expressed as $Z_3=\sqrt{(Z_1 \times Z_2)}$. These strip lines 71*a*, 71*b*, 73*a* and the resistor element 72 are components of so called Wilkinson's multiplexing/branching means (connecting means) 71. The received waves from the antennas 51 and 52 are multiplexed and then supplied to the strip line 31. Inversely, an electromagnetic wave from the strip line 31 is branched to the antennas 51 and 52. For example, when each impedance of the antennas 51 and 52 is 50 Ω, each impedance of the strip lines 71*a* and 71*b* is 59.4 Ω, impedance of the strip line 73*a* is 42.0 Ω, resistance value of the resistor element 72 is 100 Ω and impedance of the strip line 31 is 50 Ω, a multiplexing/branching in matched impedance is performed well.

As mentioned above, according to the present invention, the antenna can be formed in compact size maintaining the same level sensitivity as in a conventional two wavelength antenna, and an efficient waveguide mode-strip line mode conversion can be performed more efficiently compared with the prior art. Since the antenna can be formed in compact size, in the case of the strip line constructed by series connections of Josephson junctions, more Josephson junctions can be arranged on the array substrate 11 compared with the prior art if the area of the substrate is the same. In the case of embodiment shown in FIG. 5A, 20% of the array substrate 11 is occupied by the antenna portion and 80% is for the Josephson junction array portion while in the conventional case shown in FIG. 1, 36% of the array substrate 11 is for antenna portion and 64% is for the Josephson junction array portion. In both cases above, the antenna sensitivity is approximately equal to each other. Therefore, if the area of the array substrate 11 is the same, the apparatus of the present invention can provide higher Josephson voltage than the conventional apparatus.

In addition, according to the present invention, each of the divided portions of the strip line 31 can be driven by each of the corresponding one of a plurality of antennas, and thus each portion of the long strip line 31 can sufficiently be driven. That is, in the present invention, if the total length of the strip line is the same, the strip line length from a driving point to a termination point is shorter than the case of the prior art and the strip line loss is less accordingly. From this point, higher Josephson voltage can also be obtained compared with a prior art case.

By setting the ratio R/W of the curvature diameter R of a turning portion of a strip line to the width W of a signal line 29 to approximately 3.5, the loss by a small curvature can be reduced. In addition, by setting the ratio S/W of the line interval S of strip lines to the signal line width W to approximately 1.5, the line interval can be made small maintaining the small loss.

Furthermore, by using an fin-line antenna of which the contained angle is less than 6.6 degrees, the insertion loss can be reduced.

In the embodiment shown in FIG. 5, when the size of the array substrate is 10.5×17.0 $mm^2$, R/W is 3.5, S/W is 1.5, the number of Josephson junctions arranged on the substrate is 25,944 and a millimetric wave of 94 GHz and 13 mW is applied, 18.5 V of Josephson voltage is obtained. This is 37% improvement over the conventional case. Incidentally, in the conventional case shown in FIG. 1, the size of the array substrate is 19×10.5 $mm^2$ and the number of Josephson junctions arranged on the substrate is 18,992.

What is claimed is:

1. A waveguide mode-strip line mode converter comprising:

a dielectric substrate comprising a portion adapted for insertion into a waveguide;

n antennas formed on said portion of the substrate adapted for insertion into a waveguide, wherein n is an integer equal to or greater than 2;

a strip line formed on a portion of said substrate which is not inserted into a waveguide, said strip line comprising one end formed as a signal input/output terminal; and connecting means for connecting the other end of said strip line to each of said n antennas in terms of high frequency, each of said n antennas being a fin-line antenna having its length equal to or less than one wavelength of an electro-magnetic wave used, said wavelength being a reduced wavelength on said substrate.

2. The mode converter according to claim 1, wherein a contained angle formed by two fins of each of said n fin-line antennas is less than approximately 6.6 degrees.

3. The mode converter according to claim 2 wherein a number of said n fin-line antennas is two, and the two fin-line antennas are arranged in juxtaposition with each other such that their longitudinal lengths are in parallel with each other, and the inner fins of said two antennas are integrally formed with each other, and the total length of said two antennas in a direction orthogonal to the longitudinal direction is approximately equal to the inner height of said waveguide into which said portion of the substrate is to be inserted.

4. A waveguide mode-strip line mode converter comprising:

a dielectric substrate comprising a portion adapted for insertion into a waveguide;

n antennas formed on said portion of the substrate adapted for insertion into a waveguide, wherein n is an integer equal to or greater than 2;

a strip line formed on a portion of said substrate which is not inserted into a waveguide, said strip line having a signal line comprising Josephson junctions connected in series with one another as well as being divided into 4n portions in terms of high frequency, both ends of said strip line being formed as output terminals; and connecting means for connecting each group of 4 of the divided 4n portions of said strip line to a corresponding one of said n antennas in terms of high frequency, each of said n antennas being a fin-line antenna having its length equal to or less than one wavelength of an electro-magnetic wave used, said wavelength being a reduced wavelength on said substrate.

5. The mode converter according to claim 4, wherein the ratio S/W of the interval S between adjacent portions of said signal line to the width W of said signal line is approximately 1.5.

6. The mode converter according to claim 4, wherein the ratio R/W of the curvature diameter R of a turning portion of a signal line of said strip line to the width W of the signal line is approximately 3.5.

7. The mode converter according to claim 6, wherein the ratio S/W of the interval S between adjacent portions of said signal line to the width W of said signal line is approximately 1.5.

8. The mode converter according to claim 4, wherein a contained angle formed by two fins of each of said n fin-line antennas is less than approximately 6.6 degrees.

9. The mode converter according to claim 8, wherein the ratio S/W of the interval S between adjacent portions of said signal line to the width W of said signal line is approximately 1.5.

10. The mode converter according to claim 8, wherein the ratio R/W of the curvature diameter R of a turning portion of a signal line of said strip line to the width W of the signal line is approximately 3.5.

11. The mode converter according to claim 10, wherein the ratio S/W of the intervals between adjacent portions of said signal line to the width W of said signal line is approximately 1.5.

12. The mode converter according to claim 8, wherein a number of said n fin-line antennas is two, and the two fin-line antennas are arranged in Juxtaposition with each other such that their longitudinal lengths are in parallel with each other, and the inner fins of said two antennas are integrally formed with each other, and the total length of said two antennas in a direction orthogonal to the longitudinal direction is made approximately equal to the inner height of a waveguide into which said portion of the substrate is to be inserted.

13. The mode converter according to claim 12, wherein the ratio S/W of the interval S between adjacent portions of said signal line to the width W of said signal line is approximately 1.5.

14. The mode converter according to claim 12, wherein the ratio R/W of the curvature diameter R of a turning portion of a signal line of said strip line to the width W of the signal line is approximately 3.5.

15. The mode converter according to claim 14, wherein the ratio S/W of the interval S between adjacent portions of said signal line to the width W of said signal line is approximately 1.5.

16. The mode converter according to claim 12, wherein each of the divided eight portions of said strip line is formed by folding said strip line extending along the longitudinal direction of said fin-line antenna a plurality of times, four of the eight strip line portions are arranged in parallel with an extension of a central line between said two fin-line antennas on one side of said extension of said central line, the other four are arranged in parallel with said extension of said central line on the other side of said extension of said central line, one of said two fin-line antennas located on said one side of said central line is connected to the four strip line portions on said one side, and the other antenna located on the other side of said central line is connected to the other four strip line portions on the other side.

17. The mode converter according to claim 16, wherein the ratio S/W of the interval S between adjacent portions of said signal line to the width W of the signal line is approximately 1.5.

18. The mode converter according to claim 16, wherein the ratio R/W of the curvature diameter R of a turning portion of a signal line of said strip line to the width W of the signal line is approximately 3.5.

19. The mode converter according to claim 18, wherein the ratio S/W of the interval S between adjacent portions of said signal line to the width W of the signal line is approximately 1.5.

* * * * *